United States Patent [19]

Badon

[11] 4,046,978

[45] Sept. 6, 1977

[54] CONTACT STRUCTURE FOR PUFFER-TYPE GAS-BLAST CIRCUIT INTERRUPTER

[75] Inventor: Aimé Badon, Montbonnot-St. Martin, France

[73] Assignee: Merlin Gerin, Grenoble, France

[21] Appl. No.: 658,033

[22] Filed: Feb. 13, 1976

[30] Foreign Application Priority Data

Feb. 26, 1975 France ..... 75.06075

[51] Int. Cl.[2] ..... H01H 33/70

[52] U.S. Cl. ..... 200/148 A; 200/275

[58] Field of Search ..... 200/148 A, 275, 279

[56] References Cited

U.S. PATENT DOCUMENTS

| | | | |
|---|---|---|---|
| 2,933,575 | 4/1960 | Baker | 200/148 A |
| 4,009,458 | 2/1977 | Kishi et al. | 200/148 A |

*Primary Examiner*—Robert S. Macon

*Attorney, Agent, or Firm*—Stevens, Davis, Miller & Mosher

[57] ABSTRACT

The contact structure for a puffer-type compressed-gas circuit interrupter comprises a pair of elongated aligned axially separable contacts one of which is hollow and has an end portion provided with a plurality of axially extending, circumferentially spaced-apart contact fingers adapted to resiliently grip the other contact in telescoping relation therewith. The fingers are surrounded by a snugly sleeve ending short of the tips of the fingers permitting the puffer mechanism to direct a radial (cross-blast) jet of arc-extinguishing gas through the interstices between said tips exhausting subsequently through the interior of the tubular contact. The sleeve screens off the residual, major part of the length of the fingers to prevent a radial flow of gas therebetween at this level. It has been found that this arrangement provides an unexpected increase in the breaking power of the apparatus as compared to contact structures having sleeves covering the total length of the contact fingers or no sleeves at all.

1 Claim, 3 Drawing Figures

CONTACT STRUCTURE FOR PUFFER-TYPE GAS-BLAST CIRCUIT INTERRUPTER

This invention relates to puffer-type gas-blast circuit interrupters having a puffer mechanism to direct a blast of arc-extinguishing gas (such as sulfur hexafluoride) against an arc drawn between a pair of separable contact members. More particularly, the invention is concerned with an improved contact structure for such a circuit interrupter having a pair of elongated aligned contact members which are axially separable and one of which is tubular and has the end portion thereof provided with a plurality of generally axially extending circumferentially spaced-apart resilient contact fingers adapted to telescopically receive the confronting end portion of the other contact member in gripping relation therewith.

It is known to surround the contact fingers with a sleeve extending along the entire length thereof and well beyond the tips of the fingers. The sleeve permits to improve the path of the gas flow.

It has been found that the provision of this prior art sleeve impedes the efficient blasting of the arc roots attached to the contact fingers.

It is an object of the present invention to provide a contact structure having screened contact fingers of a design affording a better blasting of the arc roots and, more generally, improved characteristics for the flow of the blast of arc-extinguishing gas.

These and other objects and features of the invention will become apparent upon reading of the following description of an embodiment given by way of example only and shown in the annexed drawing, in which.

Figure 1:
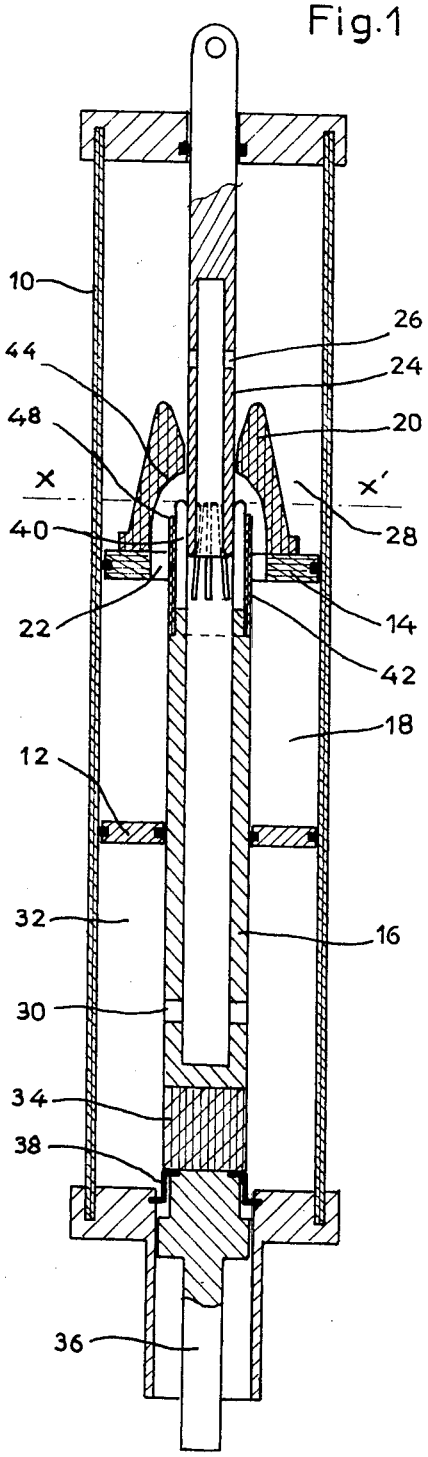
FIG. 1 is a diagrammatic view in axial cross-section of a puffer-type circuit interrupter having an improved contact structure, the contact members being shown in the closed position thereof.
Figure 2:
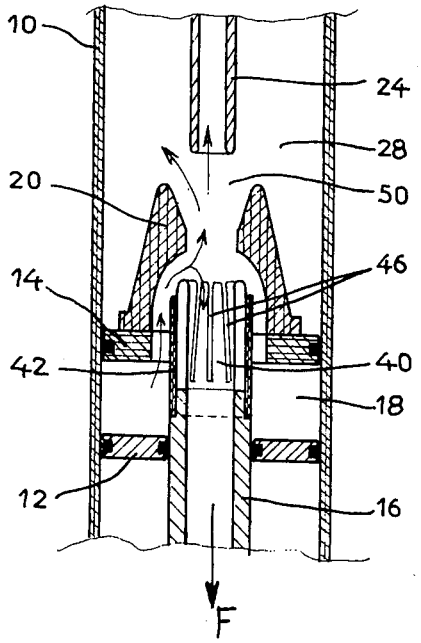
FIG. 2 is a partial view similar to FIG. 1, illustrating the contact members in the separated, open-circuit position.

The invention will now be described as applied to a puffer-type circuit interrupter disclosed in the French Pat. No. 2,064,649, having an orifice member that is movable with the movable contact member but it is to be understood that the invention may be applied to other puffer-type circuit interrupters, for example those having a movable puffer cylinder.

The circuit interrupter shown in the figures comprises a tubular enclosure or casing 10 of insulating material filled with a dielectric and arc-extinguishing gas, such as sulfur hexafluoride, of a suitable pressure. The interior of the enclosure 10 is divided into two compartments by a fixed partition wall 12. A puffer piston 14 which is movable with the tubular movable contact 16 slides along the inner wall of the cylindrical casing 10 to vary the volume of the space included between the movable piston 14 and the partition wall 12. The piston 14 carries an orifice member 20 of insulating material having the general shape of a nozzle or venturi to guide the gas blast forced through apertures 22 made in the piston 14. A hollow stationary contact member 24 cooperates with the movable contact member 16 and is provided with openings 26 establishing a communication between the interior of the venting contact 24 and the arc-extinguishing chamber. A second series of openings 30 connects the interior of the venting movable contact member 16 with the downstream compartment 32. A solid insulating portion 34 insulates the control rod 36 of the movable contact member 16 and an elastomeric diaphragm seals off the compartment 32 towards the atmosphere. The end portion of the movable contact member 16 is provided with a plurality of axially extending, circumferentially spaced-apart resilient contact fingers 40 adapted to slidingly receive the end portion of the stationary contact member 24 during the closing movement of the contacts. The telescoping arrangement of the contacts 16 and 24 permits to obtain before the separation of the contacts a precompression of the blast gas at the beginning of the operation of the rod 36 of the circuit interrupter.

According to an aspect of the invention, a tubular sleeve 42 is arranged around the contact fingers 40 of the movable contact 16 in such a manner as to end short of the tips of the fingers. The sleeve 42 covers the residual part of the fingers 40 and the interstices separating the latter. The end face 48 of the sleeve 42 directed towards the breaking interval 50 is set back from the transverse plane XX' passing through the tops of the tips of the fingers 40 so that the tips of the fingers 40 project beyond the sleeve 42. The sleeve 42 may be comprised of a tube of polytetrafluorethylene (or another appropriate plastic) having a thin lateral wall and which is adapted to expand radially elastically during the introduction of the stationary contact 24 into the movable contact 16.

Alternatively, the sleeve may be metallic and surround the fingers 40 leaving a small clearance permitting the small radial expansion of the fingers 40 during the introduction of the end portion of the stationary contact member 24.

Figure 3:
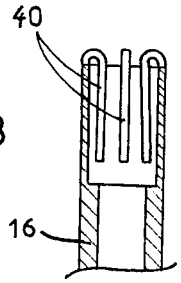
FIG. 3 is a view of a modified contact arrangement.

The modified contact arrangement shown in FIG. 3 comprises a metallic sleeve formed by the end portion of the movable contact 16 which surrounds fingers 40 bent back insides the hollow contact 16.

This device operates in the following manner:

During the initial phase of the opening movement of the contacts, the movement of the operating rod 36 in the direction of the arrow F causes the down-stroke of the movable contact member 16, of the piston 14 and of the orifice member 20 having a cylindrical throat the internal diameter of which corresponds substantially to the external diameter of the stationary contact 24. The end of the movable contact 16 slides along the end portion of the stationary contact 24 but remains for the time being in electric contact therewith. The dielectric gas precompressed in the region 18 is forced through the openings 22 into the converging section 44 of the orifice member 20. The sleeve 42 reduces the leakage of precompressed gas through the interstices 46 between the fingers 40 to a minimum.

After this initial phase, the contacts 16 and 24 separate and draw an arc between the confronting end portions thereof in the vicinity of the throat of the orifice member 20. The sleeve 42 and the convergent section 44 of the orifice member 20 direct the flow of compressed gas towards the breaking interval 50 and permit a radial blast (cross-blast) of the arc. The blasting is instantaneous from the very instant of separation of the contacts. The setback of the end 48 of the sleeve 42 from the top of the fingers causes the cross-blast of gas to cool the arc roots attached between tips of the fingers 40. The gas is subsequently exhausted through the venting passages within the contacts 16 and 24 in opposite directions to arrive finally into the compartments on either side of the partition wall 12, respectively. The sleeve 42 prevents the ionized gases passing through the movable contact 16 from contaminating the cool gas directed by the puffer mechanism towards the breaking interval 50. At the passage of the current through zero the arc is extinguished and the rapid deionization of the breaking interval 50 by the fresh compressed gas maintains the insulation between the contacts.

What I claim is:

1. A contact structure for a circuit interrupter comprising a pair of elongated aligned contact members axially separable to draw an arc between the confronting end portions of said contact members, and a puffer mechanism to produce a blast of compressed gas directed towards said arc, one of said contact members being tubular and having the end portion thereof provided with a plurality of generally axially extending circumferentiallyspaced-apart resilient contact fingers adapted to telescopically receive the confronting end portion of the other contact member in gripping contact relation therewith, said contact fingers being surrounded by a cylindrical sleeve ending short of the tips of said fingers thereby permitting to direct a cross-blast of gas through the interstices between said tips to exhaust through the venting interior of said tubular contact member, said sleeve screening off the residual length portion of said fingers preventing the radial flow of fresh gas between the corresponding part of said fingers during the separation movement of said contact members.

* * * * *